US010703612B2

(12) United States Patent
Albinger et al.

(10) Patent No.: US 10,703,612 B2
(45) **Date of Patent: *Jul. 7, 2020**

(54) SYSTEM AND METHOD FOR CALCULATION OF CAPACITY CHARTS AT A LOCKED COUNTERWEIGHT POSITION

(71) Applicant: Manitowoc Crane Companies, LLC, Manitowoc, WI (US)

(72) Inventors: Timothy James Albinger, Manitowoc, WI (US); Brian Nicholas Nysse, Center City, MN (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 242 days.

This patent is subject to a terminal disclaimer.

(21) Appl. No.: 15/809,214

(22) Filed: Nov. 10, 2017

(65) Prior Publication Data

US 2019/0144247 A1 May 16, 2019

(51) Int. Cl.
*B66C 15/00* (2006.01)
*B66C 13/16* (2006.01)
(Continued)

(52) U.S. Cl.
CPC ..... *B66C 13/16* (2013.01); *B66C 13/18* (2013.01); *B66C 15/00* (2013.01); *B66C 23/36* (2013.01);
(Continued)

(58) Field of Classification Search
CPC ..... B66C 13/16; B66C 13/18; B66C 15/00; B66C 23/36; B66C 23/76; B66C 2700/0371; B66C 13/46
See application file for complete search history.

(56) References Cited

U.S. PATENT DOCUMENTS 5,265,741 A 11/1993 Yuzo et al.
5,598,935 A * 2/1997 Harrison ..... B62D 49/085 180/69.1
(Continued)

FOREIGN PATENT DOCUMENTS

CN 101934989 A 1/2011
CN 103046606 A 4/2013
(Continued)

OTHER PUBLICATIONS

Shen et al., The realization of optimization on balance system of large floating crane with full rotation based on genetic algorithmic, 2011, IEEE, p. 85-89 (Year: 2011).*
(Continued)

*Primary Examiner* — McDieunel Marc
(74) *Attorney, Agent, or Firm* — Ramey & Schwaller, LLP; Craig Buschmann

(57) ABSTRACT

A method for calculating a crane capacity for a crane having a variable position counterweight at a locked position includes determining a boom combination and determining a maximum capacity at a hook position for the boom combination. A maximum target value for an operating condition dependent on a balance of the crane is determined. An indication of the locked counterweight position is received. At least one new target value for the operating condition dependent on the balance of the crane between the variable position counterweight at the locked counterweight position is established. A new capacity of the crane is calculated by decrementing the maximum capacity of the crane proportionally to a difference in the maximum target value and the at least one new target value. Cranes and crane control systems may employ this method.

19 Claims, 6 Drawing Sheets

(51) Int. Cl.

| | |
|---|---|
| ***B66C 23/76*** | (2006.01) |
| ***B66C 13/18*** | (2006.01) |
| ***B66C 23/36*** | (2006.01) |

(52) U.S. Cl.
CPC ..... *B66C 23/76* (2013.01); *B66C 2700/0371* (2013.01)

(56) References Cited

U.S. PATENT DOCUMENTS

| | | | | |
|---|---|---|---|---|
| 7,252,203 | B2 * | 8/2007 | Frankenberger | B66C 23/74 212/278 |
| 7,546,928 | B2 * | 6/2009 | Pech | B66C 23/76 212/196 |
| 9,783,395 | B2 * | 10/2017 | Albinger | B66C 13/16 |
| 10,173,868 | B2 * | 1/2019 | Nysse | B66C 23/76 |
| 2011/0247992 | A1 * | 10/2011 | Pech | B66C 23/76 212/196 |
| 2013/0013251 | A1 * | 1/2013 | Schoonmaker | B66C 13/46 702/152 |
| 2013/0153525 | A1 * | 6/2013 | Pech | B66C 23/76 212/196 |
| 2013/0319964 | A1 * | 12/2013 | Pech | B66C 23/76 212/196 |
| 2015/0251882 | A1 * | 9/2015 | Pech | B66C 23/76 212/197 |
| 2016/0107866 | A1 * | 4/2016 | Schoonmaker | B66C 13/46 701/50 |
| 2016/0289047 | A1 * | 10/2016 | Albinger | B66C 13/16 |
| 2018/0179030 | A1 * | 6/2018 | Nysse | B66C 23/76 |

FOREIGN PATENT DOCUMENTS

| | | | |
|---|---|---|---|
| CN | 102275837 | A | 3/2015 |
| DE | 20203686 | U1 | 7/2002 |
| DE | 29924978 | A8 | 8/2007 |
| JP | H09328293 | A | 12/1997 |
| JP | H1149484 | A | 2/1999 |
| WO | 9421549 | A1 | 9/1994 |

OTHER PUBLICATIONS

An et al., Load distribution and optimization method for cooperative lifting of double cranes considering the minimal lifting consumption, 2014, IEEE, p. 2969-2974 (Year: 2014).*

Golafshani et al., Computation of time-optimal trajectories for tower cranes, 1995, IEEE, p. 1134-1139 (Year: 1995).*

An et al.,A calculation method of crane deflection considering the boom gap, 2015, IEEE, p. 1-5 (Year: 2015).*

Non-Final Office Action dated Mar. 27, 2018, in Chinese Application No. 201610416317.2.

Preliminary Report on Patentability dated Dec. 21, 2017, in International Application No. PCT/US16/36978.

International Search Report dated Sep. 19, 2016, in International Application No. PCT/US16/36978.

Examination Report dated Feb. 2, 2018, in European Application No. 16163096.7.

Non-Final Office Action dated Apr. 23, 2016, in U.S. Appl. No. 15/579,367.

European Search Report dated Aug. 31, 2016, in European Application No. 16163096.7.

Non-Final Office Action dated Jan. 26, 2017, in U.S. Appl. No. 15/082,284.

Notice of Allowance dated Jun. 8, 2017, in U.S. Appl. No. 15/082,284.

* cited by examiner

SYSTEM AND METHOD FOR CALCULATION OF CAPACITY CHARTS AT A LOCKED COUNTERWEIGHT POSITION

TECHNICAL FIELD

The disclosed subject matter relates to systems and methods for calculating crane capacity charts and more particularly, to calculating capacity charts for a crane with a variable position counterweight at a locked counterweight position.

BACKGROUND

Cranes typically include counterweights to help balance the crane when the crane lifts a load. Since the load is often moved in and out with respect to the center of rotation of the crane, and thus generates different load moments throughout a crane pick, move and set operation, it is advantageous if the counterweight, including any extra counterweight attachments, can also be moved forward and backward with respect to the center of rotation of the crane. In this way a smaller amount of counterweight can be utilized than would be necessary if the counterweight had to be kept at a fixed distance.

A crane includes capacity charts developed by the manufacturer that specify a maximum weight a crane may lift with a given boom combination. Because a crane may be operated with a variety of boom combinations with varying lengths of boom components, a large number of capacity charts are required. For example, a simple crane having either a standard boom or luffing jib, five different lengths of booms, and five different jib lengths, would require thirty different capacity charts. Furthermore, each capacity chart would need to calculate the capacity of the crane for each distance from the center of rotation that a lift may occur.

When a variable position counterweight is used, the capacity is typically calculated with the variable position counterweight at its furthest extent, since this will result in the highest capacity for the crane. However, there are instances in which an operator may not want the variable position counterweight to extend to it greatest extent. For example, if an operator is operating the crane near a wall, the variable position counterweight may contact the wall if it were to be moved to its furthest extent.

Furthermore, sometimes a need arises in which it would be beneficial to lock or fix the position of the variable position counterweight in one location. This may occur for several reasons, including a desire to speed up cycle times by eliminating any delay that may occur while the variable position counterweight moves to its optimal position; to minimize the tailswing of the crane (e.g., such as when operating near an obstacle); to permit the crane with a variable position counterweight to operate as a traditional crane; to permit a crane operator the opportunity to affect the attitude of the crane and its effective ground bearing pressure (GBP); to accommodate for a mechanical failure in the actuating mechanism of the variable position counterweight that does not otherwise affect the safety of the crane; and to accommodate precision lifts during which movement of the variable position counterweight might have an effect on the placement of a lifted load.

For this reason, capacity charts are also generated for the counterweight at a position less than the maximum extent. A crane may have a variable position counterweight that extends nearly sixty feet from the center of rotation of the crane, but an operator may be interested in the capacity of the crane with the counterweight at a position less than sixty feet, such as at fifty feet. Since each position requires each of the load charts described previously to be recalculated, a limited number of positions are selected for generation of capacity charts. The crane with a variable position counterweight having a sixty foot maximum extent may choose three discreet positions for calculation of capacity charts, resulting in three times as many capacity charts as compared to a fixed counterweight.

If an operator needs to use the crane within a confined space, the operator must select either select a discrete position of the counterweight that is less than the available space, but that corresponds to a position on the capacity charts, or use the available space, but limit lifts to the capacity given for the discrete position of the capacity chart. Because a limited number of positions are selected for generating capacity charts, the intermediate position in the capacity charts may be substantially less than the available space. Using the previously example of a variable position counterweight have a sixty foot maximum extent and three discreet positions for calculating a capacity chart, each discreet position may be separated by twenty feet, with load charts at a twenty foot extent, a forty foot extent, and the maximum, sixty foot extent. If the operator needs to limit the counterweight to less than fifty feet, they would need to select a capacity corresponding to the counterweight position of forty feet. This results in a crane capacity that is substantially less than what would be available if the capacity were determined with the counterweight being able to extend to use all of the available space.

Crane operators would prefer to maximize the capacity their crane by having a large number of available intermediate positions used for calculating load charts. However, this substantially increase the amount of paper charts that must be maintained, the amount of data stored in the crane, and the number of calculations that must be performed. Thus, there is a need for providing a crane operator with crane capacity charts at a large number of discrete positions, while limiting the amount of paper capacity charts, data stored in the crane, and the total number of calculations required. In turn, these methods increase the flexibility and ease of use of cranes with a variable position counterweight system.

BRIEF SUMMARY

Embodiments include a method for determining a capacity of a boom combination for a crane having a variable position counterweight in an intermediate position. The method includes determining a boom combination of a crane having a variable position counterweight, determining a maximum capacity at a hook position for the boom combination, establishing a target value for an operating condition dependent on a balance of the crane between the variable position counterweight and a load on the hook, receiving an indication of an intermediate counterweight position, calculating a load on the hook at the hook position for the boom combination and intermediate counterweight position that results in the operating condition having the target value to determine an intermediate capacity, comparing the intermediate capacity with the maximum capacity, and outputting the lower of the maximum capacity and the intermediate capacity.

In some embodiments, outputting the lower of the maximum capacity and the intermediate capacity includes displaying the higher of the maximum capacity and the intermediate capacity on a visual display.

In some embodiments, determining a boom combination includes receiving a user input identifying a boom combination. In some embodiments, determining a boom combination includes detecting, by a sensor, at least one component making up the combination.

In some embodiments, determining the maximum capacity includes looking up a load chart for the determined boom configuration.

In some embodiments, the operating condition includes a backhitch tension.

In some embodiments, calculating a load includes summing a load moment of a beam supporting the variable position counterweight, a load moment of a mast hinge supporting a mast, and load moment of a boom hinge supporting a boom.

In another aspect, a crane control system is disclosed. The crane control system includes a processor configured to implement computer executable instructions, a first input interface in communication with the processor and configured to receive an indication of an intermediate position, a second input interface in communication with the processor and configured to receive a sensor input corresponding to an operating condition indicative of a balance between a load on a crane boom and a variable position counterweight, a first output interface in communication with the processor and configured to output a control signal for controlling the position of the variable position counterweight, a second output interface in communication with the processor and configured to output an indication of intermediate crane capacity, and computer memory in communication with the processor and storing data representing a load chart and computer executable instructions, that when implemented by the processor cause the processor to perform functions. The functions include calculating the control signal for controlling the position of the variable position counterweight based on keeping a sensor input received at the second input interface at a predetermined value, calculating an intermediate crane capacity based on an indication of an intermediate counterweight position received over the first interface and a known value of the operating condition indicative of a balance between a crane boom and a variable position counterweight, comparing the intermediate crane capacity to a capacity indicated by the load chart for the boom combination, and outputting an indication of the lower of the intermediate capacity and the capacity indicated by the load chart over the second output interface.

In some embodiments, the sensor input is configured to receive the output of strain gauge in a back hitch.

In some embodiments, calculating an intermediate crane capacity includes summing a load moment of a beam supporting the variable position counterweight, a load moment of a mast hinge supporting a mast, and load moment of a boom hinge supporting a boom.

In some embodiments, the system further includes a third input configured to receive an indication of a boom combination.

In another aspect, a crane is disclosed. The crane includes an upper works, a boom mounted to the upper works at a first end and having a hook at a second end, a variable position counterweight horizontally extendable from the upper works, a counterweight movement device configured to move the variable position counterweight relative to the upper works, a sensor configured to measure an operating condition indicative of the balance between a load on the hook and the counterweight; and a crane control system in communication with the actuator and the sensor. The crane control system includes a processor configured to implement computer executable instructions, an input in communication with the processor and configured to receive an indication of an intermediate position, an output in communication with the processor and configured to output an indication of intermediate crane capacity; and computer memory in communication with the processor and storing data representing a load chart and computer executable instructions, that when implemented by the processor cause the processor to perform functions. The functions includes calculating a control signal for the actuator, the control signal causing the actuator to adjust the position of the variable position counterweight to maintain the operating condition measured by the sensor at a predetermined value, calculating an intermediate crane capacity based on an indication of an intermediate counterweight position received over the input and the predetermined operating condition indicative of a balance between the load on the hook and the variable position counterweight, comparing a capacity indicated by the load chart for the boom combination to the intermediate crane capacity, and outputting an indication of the lower of the capacity indicated by the load chart and the intermediate crane capacity over the output.

In some embodiments, the crane further includes a fixed mast coupled to the upper works and a back hitch between the fixed mast and the variable position counterweight, and the sensor is a strain gauge configured to measure the tension in the back hitch.

In some embodiments, calculating an intermediate crane capacity includes summing a load moment of a beam supporting the variable position counterweight, a load moment of a mast hinge supporting a mast, and load moment of a boom hinge supporting a boom.

In some embodiments, the crane further includes a third input configured to receive an indication of a boom combination.

Yet another embodiment of a method for determining a capacity of a boom combination for a crane having a variable position counterweight in a locked position includes determining a boom combination of the crane and determining a maximum capacity of the crane at a hook position for the boom combination. A maximum target value for an operating condition dependent on a balance of the crane between the variable position counterweight at a first distance from a center of rotation of the crane and a load on the hook is determined. An indication of the locked counterweight position at a second distance from the center of rotation that is different than the first distance is received. At least one new target value for the operating condition dependent on the balance of the crane between the variable position counterweight at the second distance and the load on the hook is established. The method further includes calculating a new capacity of the crane by decrementing the maximum capacity of the crane proportionally to a difference in the maximum target value and the at least one new target value.

Optionally, the method further includes preventing the variable position counterweight from moving to the locked position when at least one of (a) the new target value of the operating condition is greater than the maximum target value of the operating condition and (b) the new capacity of the crane is less than a minimum capacity.

In some embodiments, determining the boom combination comprises receiving a user input identifying a boom combination. Alternatively, in some embodiments, wherein determining a boom combination comprises detecting, by a sensor, at least one component making up the combination.

In some embodiments, determining the maximum capacity comprises looking up a load chart for the determined boom combination.

In some embodiments, the operating condition comprises a moment calculated about a fixed point on the crane. Optionally, the moment may comprise summing a load moment of at least one of a counterweight support beam supporting the variable position counterweight and a rotating bed supporting the variable position counterweight, a load moment of a mast hinge supporting at least one of a fixed mast and a live mast, and a load moment of a boom hinge supporting a boom.

Yet other embodiments of a crane control system include a processor configured to implement computer executable instructions. A first input interface is in communication with the processor and configured to receive an indication of a locked position of a variable position counterweight. A second input interface is in communication with the processor and configured to receive an input corresponding to an operating condition indicative of a balance between a load on a crane boom and a variable position counterweight. A first output interface is in communication with the processor and configured to output a control signal for controlling the position of the variable position counterweight. A second output interface is in communication with the processor and configured to output an indication of a new capacity of the crane. A computer memory is in communication with the processor and storing data representing a load chart and computer executable instructions, that when implemented by the processor cause the processor to perform functions. The functions that the processor performs include calculating the control signal for controlling the position of the variable position counterweight based on keeping the input received at the second input interface at or below a maximum target value for the operating condition dependent on a balance of the crane between the variable position counterweight at a first distance from a center of rotation of the crane and a load on the hook; determining a maximum capacity of the crane at a hook position for the boom combination; calculating at least one new target value for the operating condition based on the indication of the locked counterweight position received over the first interface and dependent on the balance of the crane between the variable position counterweight at a second distance that is different than the first distance and the load on the hook; calculating a new capacity of the crane by decrementing the maximum capacity of the crane proportionally to a difference in the maximum target value and the at least one new target value; and outputting an indication of the new capacity over the second output interface.

Embodiments of the crane control system may include a processor that also performs functions comprising prevent the variable position counterweight from moving to the locked position when at least one of (a) the new target value of the operating condition is greater than the maximum target value of the operating condition and (b) the new capacity of the crane is less than a minimum capacity.

In some embodiments of the crane control system, the operating condition comprises a moment calculated about a fixed point on the crane. Optionally, the moment comprises summing a load moment of at least one of a beam counterweight support beam supporting the variable position counterweight and a frame rotating bed supporting the variable position counterweight, a load moment of a mast hinge supporting at least one of a fixed mast and a live mast, and a load moment of a boom hinge supporting a boom.

In some embodiments of the crane control system further comprises a third input configured to receive an indication of a boom combination.

In some embodiments of the crane control system, the function to determine the maximum capacity comprises looking up the load chart for the determined boom combination.

In yet another embodiment a crane comprises an upper works, a boom mounted to the upper works at a first end and having a hook at a second end, a variable position counterweight horizontally extendable from the upper works, a counterweight movement device configured to move the variable position counterweight relative to the upper works, and a crane control system as described above.

DETAILED DESCRIPTION

Embodiments of the present disclosure will now be further described. In the following passages, different aspects of the disclosure are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Figure 1:
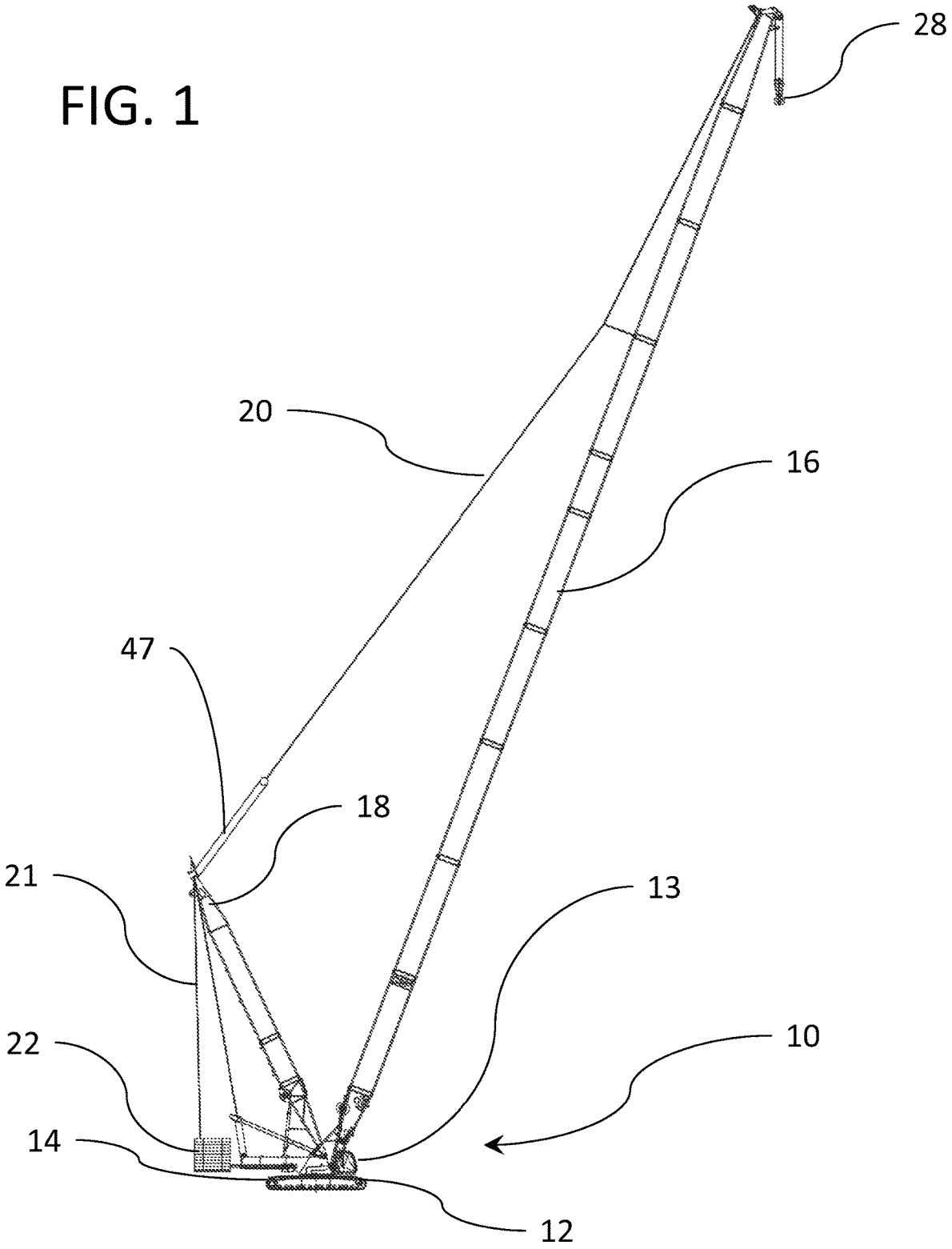
FIG. 1 illustrates a side view of a mobile crane.

While the described embodiments will have applicability to many types of cranes, it will be described in connection with mobile crane 10, shown in an operational configuration in FIG. 1 and in an enlarged view in FIG. 2. The mobile crane 10 generally includes a lower works 12 and upper works 13. The lower works 12 include moveable ground engaging members in the form of crawlers 14. There are two crawlers 14, one on either side of the crane 10, only one of which can be seen from the side views of FIG. 1 and FIG. 2. In the crane 10, the ground engaging members could be multiple sets of crawlers, one set of crawlers on each side. Of course additional crawlers other than those shown can be used, as well-as other types of ground engaging members, such as tires.

The upper works 13 include a rotating bed 24 having a slewing ring 26, such that the rotating bed 24 can swing about an axis with respect to the lower works 12, support columns in the form of a boom 16 and a mast 18, boom suspension 20, a variable position counter weight assembly 22, and a back hitch 21. The rotating bed 24 supports the boom 16 pivotally mounted on a front portion of the rotating bed 24; the mast 18 mounted at its first end on the rotating bed 24; and the counterweight unit 22. The counterweight unit 22 may be in the form of multiple stacks of individual counterweight members on a support member.

The counterweight unit 22 is movable with respect to the remainder of the rotating bed 24. In the crane 10, the rotating bed 24 includes a counterweight support beam or counterweight support frame 33 supporting the movable counterweight unit 22 in a movable relationship with respect to the rotating bed 24. The counterweight support frame 33 includes flanges extending laterally from the counterweight support frame 33. The counterweight unit 22 moves on the surface of the flanges as the counterweight support frame 33 extends rearwardly. A counterweight tray, housing the counterweights, includes rollers, which rest on the flanges. The rollers are secured on the top of the counterweight tray 33 so that the counterweight tray is suspended beneath the counterweight support 33. In the crane 10, the counterweight support frame constitutes the fixed rearmost portion of the rotating bed 24.

A counterweight movement system is connected between the rotating bed 24 and the counterweight unit 22 so as to be able to move the counterweight unit 22 toward and away from the boom 16. The counterweight unit 22 is movable between a position where the counterweight unit 22 is in front of the fixed rearmost portion of the rotating bed 20, such that the tail swing of the crane 10 is dictated by the fixed rearmost portion of the rotating bed 20 (as seen in FIG. 3), and a position where the counterweight unit 35 dictates the tail swing of the crane 10 (as seen in FIG. 2). The counterweight movement system in the crane 10 includes a counterweight unit movement device made up of a drive motor and a drum on a rear of the counterweight support frame 33. Preferably the counterweight unit movement device has two spaced apart identical assemblies, and thus the drive motor drives two drums. Each assembly of the counterweight unit movement device further includes a flexible tension member that passes around a driven pulley and idler pulley. The flexible tension member may be a wire rope, or a chain. Both ends of each flexible tension member are connected to the counterweight tray, so that the counterweight unit 22 can be pulled both toward and away from the boom 16. Preferably this is accomplished by having an eye on both ends of the flexible tension member or wire rope and holes in a connector on the counterweight tray, with pins through the eyes and the connector. Thus, in the crane 10, the counterweight unit movement device is connected between the counterweight support frame 33 and the counterweight unit 22.

Figure 2:
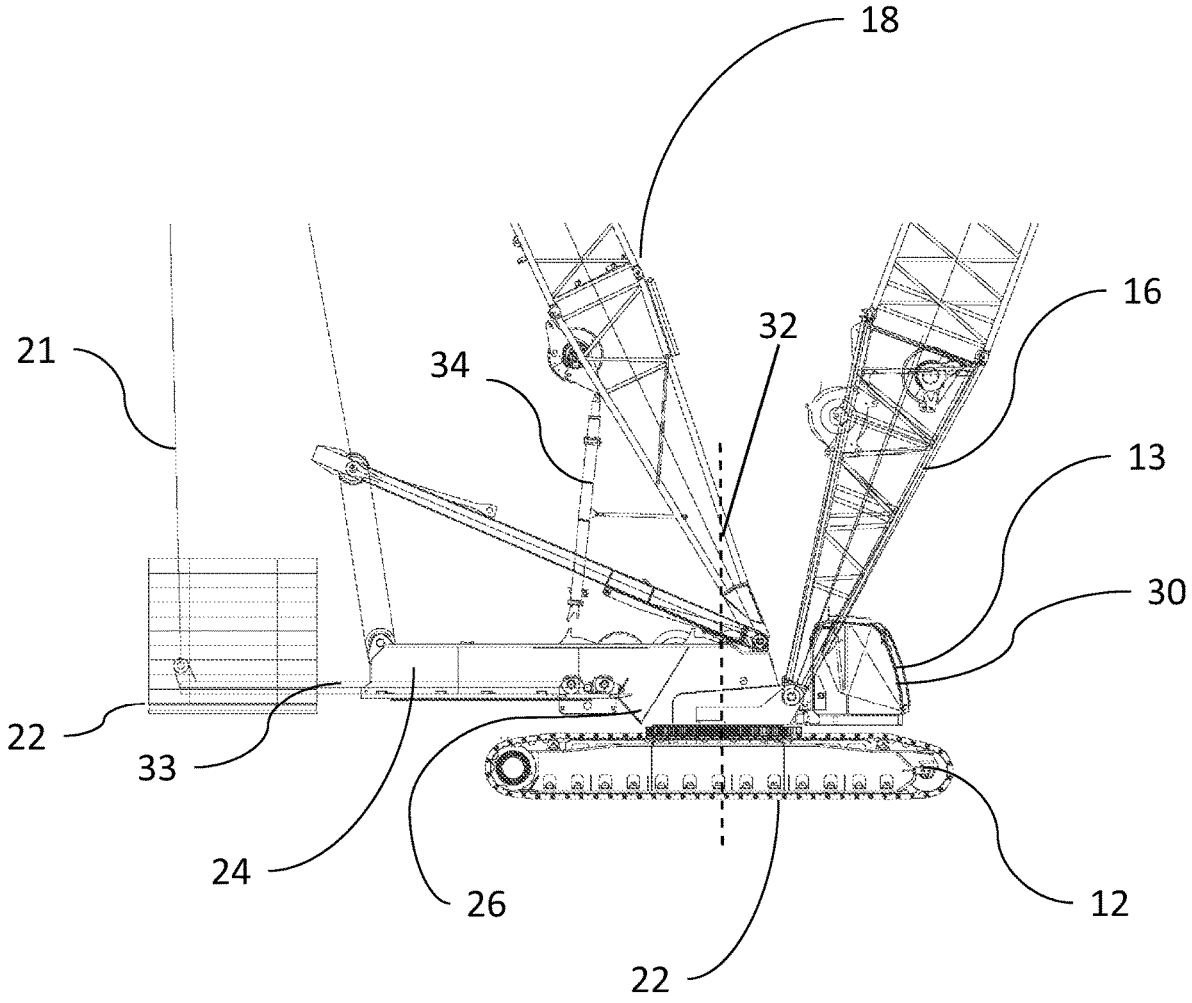
FIG. 2 illustrates a close up view of the mobile crane of FIG. 1.
Figure 3:
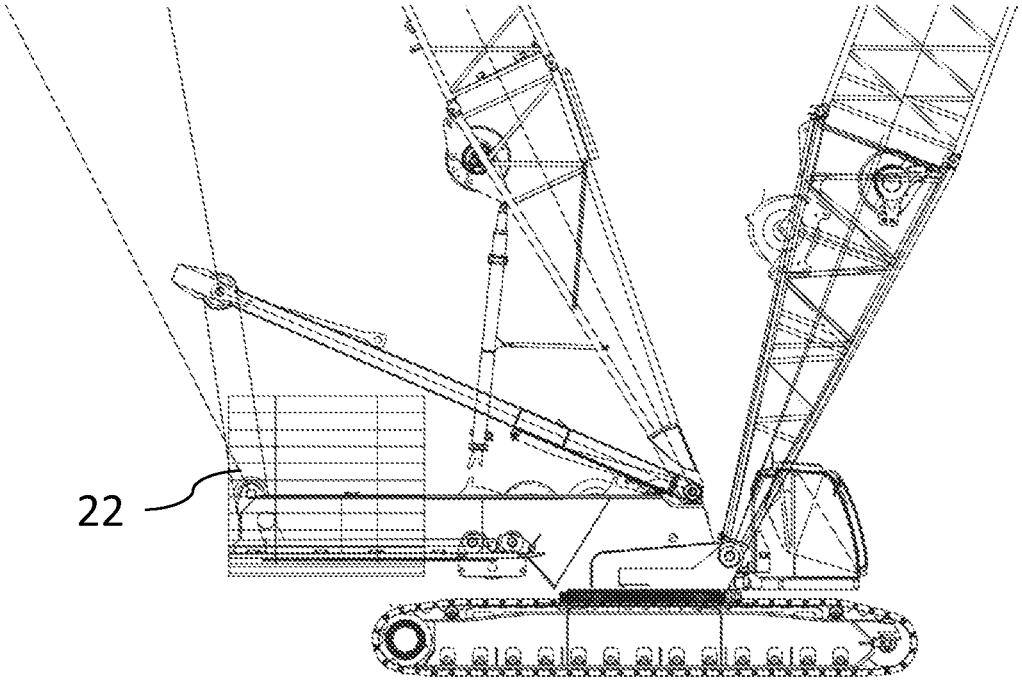
FIG. 3 illustrates a side view of an embodiment of a mobile lift crane with a counterweight assembly in a near position

FIG. 3 illustrates the counterweight unit 22 in a forward position, whereas FIG. 2 illustrated the counterweight unit 22 in a rearward position, such as when a large load is suspended from the hook 28, or the boom 16 is pivoted forward to extend a load further from the rotating bed 24. The positioning of the counterweight unit 22 is controlled by a crane controller coupled with at least one sensor detecting an operating condition indicative of a balance between a load moment caused by a load on the hook 28 and a load moment from the counterweight unit 22. The crane controller controlling the counterweight movement system, and possibly other operations of the crane, receives signals from the sensor indicating the operating condition (such as the boom angle, jib angle, tension in the hoist line indicative of the load on the hook, tension in the backhitch indicative of the load moment, tension in the boom hoist rigging indicative of the combined boom and load moment) and controls the position of the counterweight unit 22 base on the sensed operating condition. The position of the counterweight unit 22 may be detected by keeping track of the revolutions of drums, or using a cable and reel arrangement or other device (not shown) configured to detect a distance or position of the counterweight unit 22. The crane 10 using such a system will preferably include a computer readable storage medium including programming code embodied therein operable to be executed by the computer processor to control the position of the counterweight unit 22.

In normal operation, the movement of the counterweight unit 22 is controlled by setting a target value for the operating condition sensed by the sensor, and then moving the counterweight unit 22 to maintain the operating condition at the target value or below. For example, the tension in the back hitch 21 may be sensed using a strain gauge in a link of the back hitch 21. Tension in the back hitch 21 is a good approximation of the balance between the load moment of the boom 16 and the load moment of the counterweight unit 22. The sensed operating condition in this case would be the tension in the back hitch 21, which could be set to a value of eighty percent of the weight of the counterweight. Eighty percent is only an example and embodiments are not limited by this value.

In operation, the counterweight unit 22 is initially at an inner position as shown in FIG. 3. With the counterweight unit 22 in this position, the tension in the backhitch 21 is minimal and the counterweight frame 33 provides the majority of support for the counterweight unit 22. When the crane attempts a lifting operation, the tension in the backhitch 21 increases up to the target value without moving the counterweight unit 22. Once the target value is reached, the counterweight unit 22 begins moving to a position at which the tension in the back hitch 21 is at the target. As a larger load is lifted, or the boom 16 is extended farther from the crane, the counterweight unit 22 continues moving outward until it reaches its maximum extent. The target value may result in a capacity different than the actual capacity at the maximum extent of the counterweight unit 22. In such instances, the counterweight unit 22 would remain at the maximum extent as the load increases up to the actual maximum. If the load on the hook 28 is reduced, or the boom 16 is moved inward, the tension in the back hitch 21 begins to decrease and the counterweight 21 moves inward until the target tension is reached again. The target tension may be a constant value, or in some embodiments, it may be a predetermined value dependent on the position of the counterweight.

The capacity of the crane 10 is determined by the maximum load moment and the structural capacity of the crane 10. The load moment is the tipping force that a crane 10 experiences when picking up a load that is beyond a tipping plane of the crane 10. The structural capacity relates to the strength of the boom 16 and other components of the crane 10. The capacity of the crane 10 is limited by the lower of the maximum moment and the structural capacity of the crane 10. If a crane 10 were to attempt a lift beyond the structural capacity, but less than the maximum load moment, the structure of the crane 10 would fail. If a crane 10 were to attempt a lift within the structural capacity, but with a load moment exceeding its maximum capacity, the crane 10 would tip over. Capacity charts for the crane 10 take into consideration both of these capacities.

Because a crane 10 with a moveable counterweight unit 22 will always extend the counterweight 22 before reaching a maximum capacity, a capacity chart is typically generated only for the maximum extent of the counterweight 22. At this location, the crane 10 has its highest capacity. In the course of calculating a capacity chart, the normal procedure is to calculate the highest load the hook 28 can support for a given boom 16 orientation while not exceeding the maximum load moment or the structural capacity. This process is repeated for each orientation of a boom 16, and is generally given as the maximum load for a given distance the hook 28 is from the center of rotation 32 of the upper works based on the combination of the boom 16 and any jib. During operation, the position of the counterweight 22 is adjusted depending on the load being lifted, eventually reaching its maximum extent and the greatest capacity of the crane 10.

However, a novel way of generating a load chart takes advantage of the existing calculation for capacity charts at the maximum extent of the counterweight 22, and the adjustment of the counterweight 22 position. In place of manually calculating a capacity chart for every intermediate position of the counterweight 22, the load on the hook 28 that would result in the counterweight 22 moving to the intermediate position to keep the sensed operating condition at its target value is calculated. This load is known to be a safe operating condition, since during normal operation the counterweight 22 passes through this position on its way to the maximum extent.

The calculation of the load that results in the counterweight 22 at the intermediate position is a relatively simple calculation that can be computed without significant computer resources. All of the parameters are known variables and the only unknown variable being solved for is the load on the hook 28. A simple summing of moments about the counterweight beam 33, mast 18, and boom 16 given the known crane 10 geometry and counterweight 22 size can be solved for the weight on the hook 28 that results in the target value for the sensed parameter.

In some instances, the load on the hook 28 may be limited by structural capacity rather than the tipping moment. In these instances, the maximum allowed capacity will be less than that calculated by summing the moments. However, these instances are already accounted for in the existing load charts. If the capacity of the existing load chart is less than the capacity determined by summing the moments, it indicates that the capacity is limited by a structural concern, rather than the load moment. In these instances the lesser of the existing load chart capacity and the calculated load is used.

In some embodiments, operating conditions other than the tension in the back stay may be used. For example, a load moment may be detected on the counterweight frame 33, which would be held constant by moving the counterweight 22 in response to changing load moments on the boom 16.

While the foregoing discussion of the crane 10 discloses a mast 18 and a counterweight support beam or frame 33, embodiments of the disclosed methods and systems are equally applicable to cranes that include only a live mast and lack the mast 18 and the counterweight support frame 33. Such a crane is disclosed in U.S. patent application Ser. No. 15/082,284 at FIGS. 1-3 and as described in para. [0018]-[0028] of the corresponding U.S. Pat. App. Publ. No. 2016/0289047 that published Oct. 6, 2016, the entire disclosure of which is herein incorporated by reference.

Figure 4:
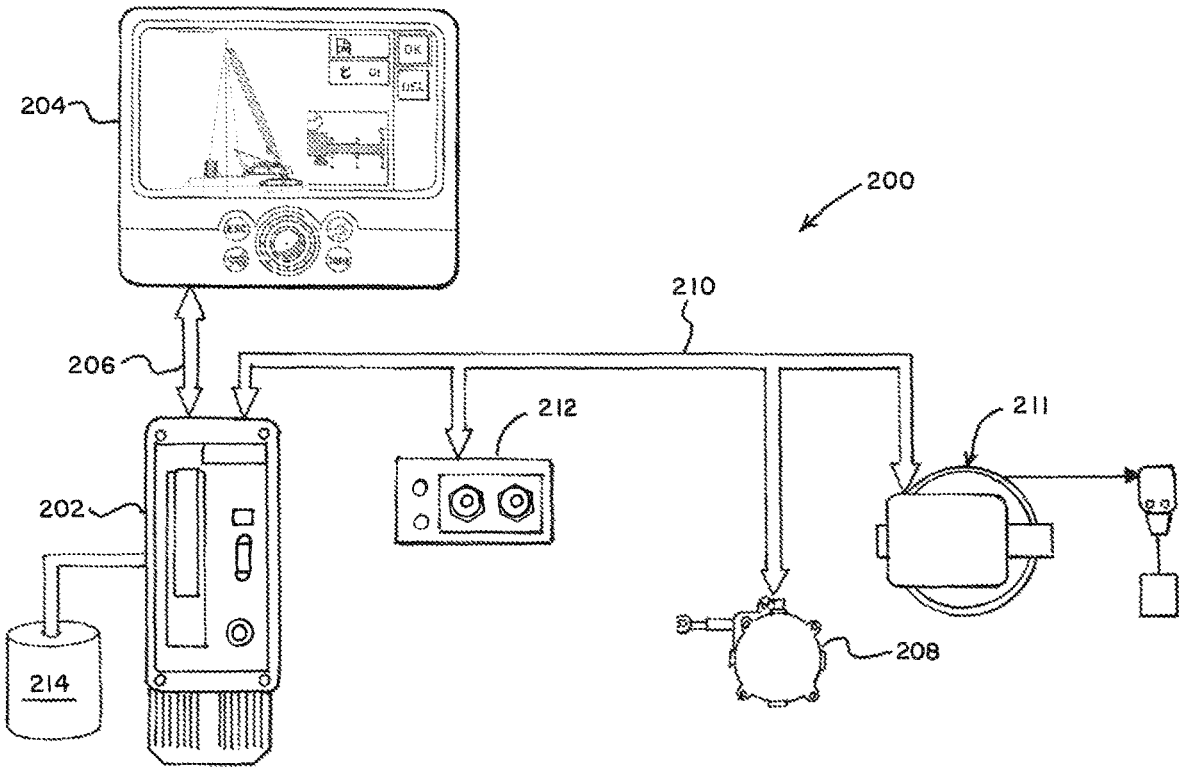
FIG. 4 illustrates a control system for controlling the position of a counterweight.

FIG. 4 illustrates a schematic of an exemplary embodiment of a crane control system 200. The crane control system 200 includes a processing unit 202 and a user interface 204 operably coupled to the processing unit 202. In the embodiment of FIG. 4, the processing unit 202 and the user interface 204 are shown as separate physical units, but in some embodiments they are a single physical unit. The processing unit 202 is operably coupled to the user interface 204 through a graphics interface 206, such as a Video Graphics Array (VGA) connector, a serial connection, a Digital Video Interface (DVI), a wireless data connection, or any other connector capable of transferring display information from the processing unit 202 to the user interface 204. The display information may be transferred directly, or in some embodiments may have at least one other device between the processing unit 202 and the user interface 204. The user interface 204 of FIG. 4 includes a liquid crystal display (LCD) for displaying information, but other display types are possible, such as organic light-emitting diodes (OLED), projection, cathode ray tube (CRT), heads up display (HUD), plasma, electronic ink, and other displays.

The exemplary embodiment 200 further includes sensors such as a length sensor 208 operably coupled to the processing unit 202. The length sensor 208 may measure the status of crane components such as position of an adjustable counterweight. In the embodiment of FIG. 4, the length sensor 208 is operably coupled to the processing unit 202 through a bus 210. Generally there are other sensors such as angle sensors, strain gauges, and moment sensors which are operably coupled to the processing unit. Any type of sensor capable of measuring a condition of the crane may be used as long as it transmits a signal representative of the condition to the processing unit 202. The sensor 208 can be an analog sensor and transmit an analog signal, the analog signal can be converted to a digital signal prior to transmission, the signal can be a digital signal, or the signal could be a digital signal converted to an analog signal prior to transmission. Other sensors 212 are operably coupled to the processing unit 202 and serve other functions such as monitoring the boom 16. The other sensors 212 provide the processing unit 202 with other signals representative of other information such as a boom angle or counterweight configuration. At least one sensor 211 is operably coupled to the processing unit and measures a load on the boom such a hoist line load, load moment on the boom, or a stress in a crane component such as the back hitch, fixed mast, or live mast. The various sensors coupled to the processing unit 202 may be used to determine a current boom combination, or other operating parameters. In other embodiments, the operating parameters may be entered manually through the graphic display 204, or a combination of sensed conditions and manually entered parameters may be used to determine the boom combination.

The processing unit 202 can be operably coupled directly to the sensor 208 as shown in FIG. 4, or in some embodiments, various components may be between the processing unit 202 and the sensor 208. The sensor 208 and the processing unit 202 are considered to be operably coupled so long as the sensor 208 is able to provide the processing unit 202 with the signal representative of the condition it is measuring.

A data storage unit 214 is operably coupled to the processing unit 202 and stores computer executable instructions for execution by the processing unit 202. The computer instructions cause the processing unit 202 to perform a series of functions that will be described in more detail later. Briefly, the computer executable instruction cause the processing unit 202 to determine a first load capacity for a determined boom configuration with the counterweight positioned at the maximum extension, and calculate a second load capacity for the determined boom configuration for with the counterweight positioned at an intermediate capacity.

In some embodiments, load chart data is input manually through the user interface 204. In other embodiments, a plurality of mobile crane load charts are stored in the data store 214 and the processing unit 202 selects an appropriate load chart based on the determined configuration. For example, if the data store 214 has three load charts based on a particular counterweight position, the processing unit 202 would select a load chart that is valid for determined configuration.

Figure 5:
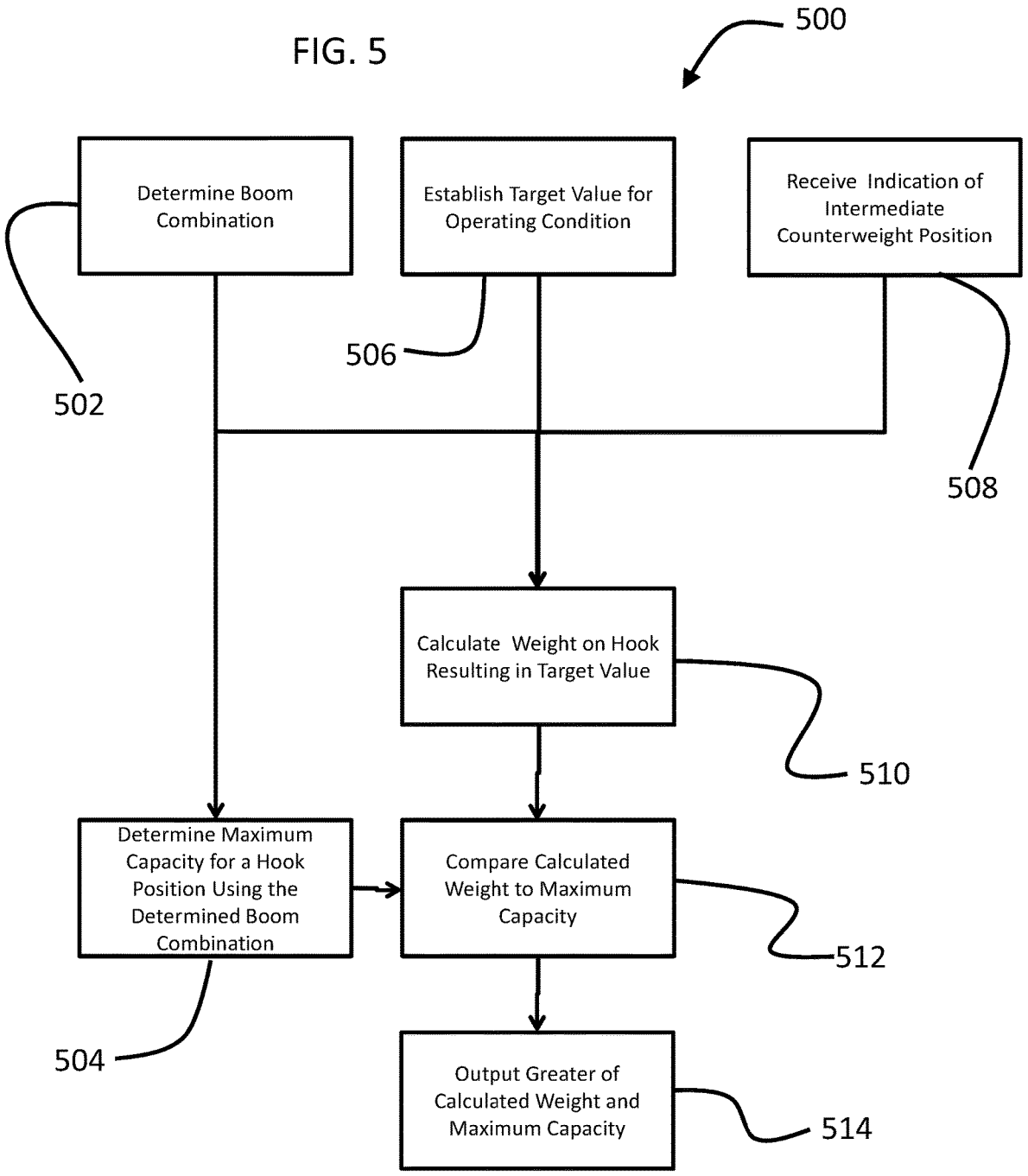
FIG. 5 illustrates a flowchart of a method for calculating a load chart for a variable position counterweight in an intermediate position.

FIG. 5 illustrates a flow chart of a method 500 for computing a load chart. Computer executable instructions stored in data store 214, may be executed by processing unit 202 to cause the crane control system 200 to perform the method 500.

The method 500 begins with the determination of a boom combination in block 502. The boom combination may be determined automatically using at least one sensor in communication with the crane control system 200. For example, the boom combination may be determined through the use of a radio frequency identifier (RFID) tag on each crane component. Or in other embodiments, the boom combination may be input manually through user interface 204. For instance, a user may use the user interface 204 of the crane control system 200 to input at least one characteristic of the boom combination such as the length of the boom or the presence of a luffing jib. Or, in still other embodiments, a combination may be used such as a user entering the boom combination and at least one sensor detecting the individual crane components.

In block 504, a maximum capacity is determined for a hook position for the determined boom combination with the counterweight at its maximum extent. The maximum capacity may be determined by looking up load chart data in a data store, or in other embodiments the maximum capacity may be entered manually through the user interface 204.

In block 506, a target value for an operating condition is established. The operating condition is a condition dependent upon balance between the load on the hook 28 and the counterweight 22. In some embodiments, the operating condition is the tension in a back hitch 21.

In block 508, an indication of an intermediate counterweight position is received. The intermediate counterweight position is the position for which a load chart is being computed. The indication of the intermediate counterweight position is entered manually by the operator, or in some embodiments, the current position of the counterweight may be sensed by a sensor in communication with the crane controller. In block 510, a load on the hook is calculated that would result in the operating condition having the target value. For example, the processing unit 202 may sum the load moments for the counterweight and mast, and then calculate the weight on hook that would result in the boom having a balancing load moment.

In block 512, the load calculated in block 510 is compared to the maximum capacity of the crane. If the load in block 510 is greater than the maximum capacity of the crane, it indicates that the capacity is limited by structure, rather than the balance of the crane. To avoid the possibility of exceeding the structural capacity of the crane, the lesser of the load calculated in block 510 and the maximum capacity is output in block 514. The capacity is output on the user interface 204 for display to the crane operator, or in other embodiments the output is saved to memory.

Figure 6:
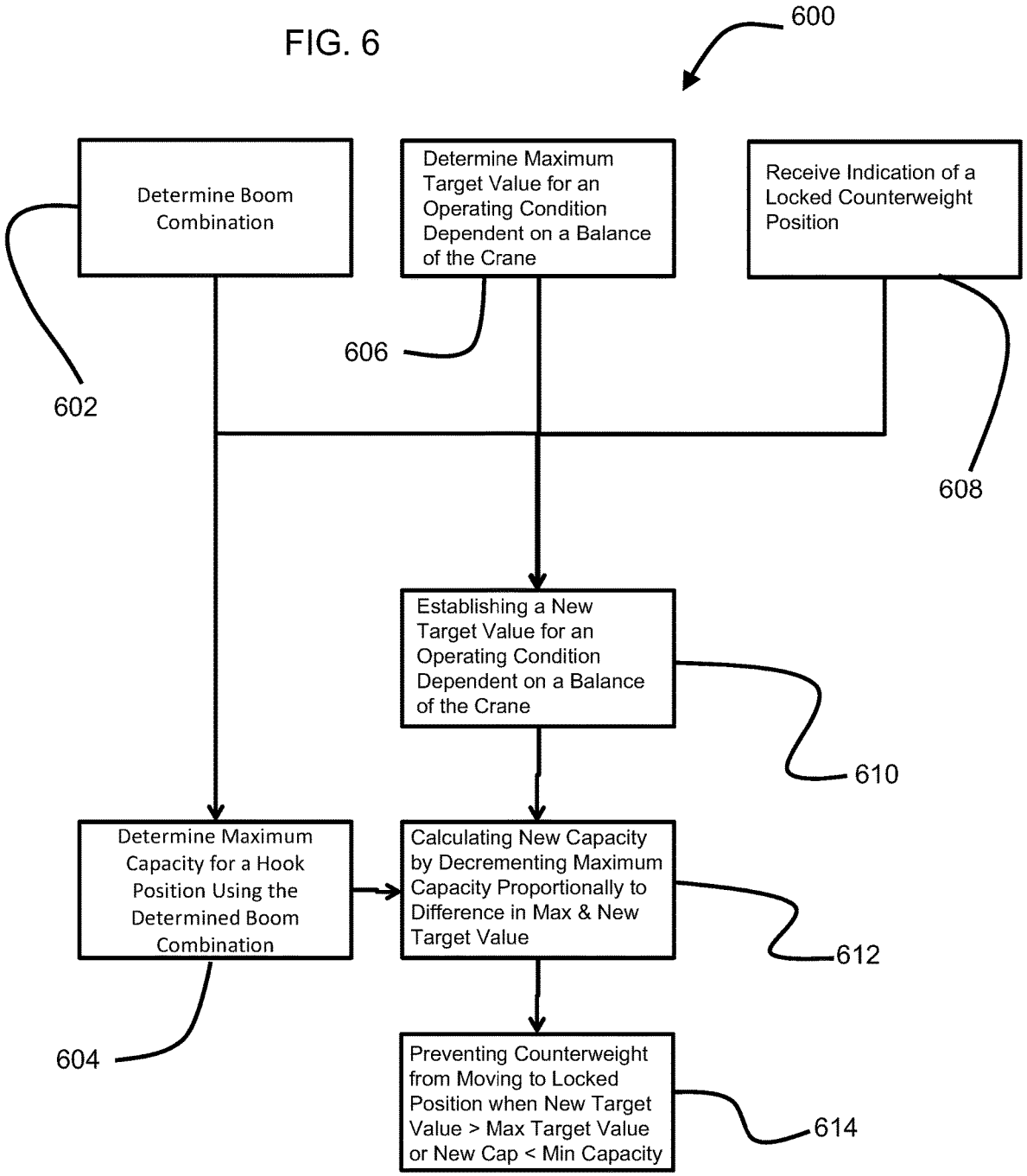
FIG. 6 illustrates a flowchart of another method for calculating a load chart for a variable position counterweight in a locked position.

FIG. 6 illustrates a flow chart of another method 600 for computing a load chart for a variable position counterweight selectively locked in a position. Computer executable instructions stored in data store 214, may be executed by processing unit 202 to cause the crane control system 200 to perform the method 600.

The method 600 begins with the determination of a boom combination in block 602. The boom combination may be determined automatically using at least one sensor in communication with the crane control system 200 as discussed above with respect to block 502.

In block 604, a maximum capacity is determined for a hook position for the determined boom combination with the counterweight at its maximum extent. The maximum capacity may be determined by looking up load chart data in a data store, or in other embodiments the maximum capacity may be entered manually through the user interface 204.

In block 606, a maximum target value for an operating condition dependent on a balance of the crane between the variable position counterweight at a first distance from a center of rotation 32 of the crane 10 and a load on the hook is established. The operating condition is a condition dependent upon balance between the load on the hook 28 and the counterweight 22. In some embodiments, the operating condition is a moment calculated about a fixed point on the crane, wherein the fixed point is any selected point. Such selected points include as non-limiting examples the center of rotation, a tipping fulcrum (either front, rear, or other tipping fulcrum). Optionally, the moment comprises summing a load moment of at least one of a counterweight support beam supporting the variable position counterweight and/or the rotating bed supporting the variable position counterweight, a load moment of a mast hinge supporting at least one of a fixed mast and a live mast, and a load moment of a boom hinge supporting a boom.

In block 608, an indication of a locked counterweight position is received. The locked counterweight position is the position for which at least one of a load chart, a new target value for an operating condition, and a new capacity is being computed. The indication of the locked counterweight position is entered manually by the operator, or in some embodiments, the current position of the counterweight may be sensed by a sensor in communication with the crane controller. Typically, the locked counterweight position is at a second distance from the center of rotation 32 that is less than a first distance from the center of rotation 32, although the second distance can just be different, i.e., less than or greater than the first distance.

In block 610, at least one new target value for the operating condition dependent on the balance of the crane between the variable position counterweight at the second distance and the load on the hook is established. For example, the processing unit 202 may sum the load moments for the counterweight and mast, and then calculate the weight on hook that would result in the boom having a balancing load moment.

In block 612, a new capacity of the crane is calculated by decrementing the maximum capacity of the crane proportionally to a difference in the maximum target value and the at least one new target value. Decrementing is of course to be understood to mean decreasing or diminishing the maximum capacity by any proportional or fractional amount. The decrementing need not be by a whole number. To avoid the possibility of exceeding the structural capacity or the maximum target value of the crane, at least one of the at least one new target value and the new capacity of the crane output on the user interface 204 for display to the crane operator, or in other embodiments the output is saved to memory.

In block 614, the control system may prevent the variable position counterweight from moving to the locked position when at least one of (a) the new target value of the operating condition is greater than the maximum target value of the operating condition, which should prevent the crane from exceeding margins for balance and/or structural capacity and (b) the new capacity of the crane is less than a minimum capacity for a hook position and boom combination. The minimum capacity may be any selected value that the crane may lift. In other words, there is a certain minimum capacity, typically at low boom angles, below which the crane cannot effectively lift a usable load.

It should be understood that various changes and modifications to the presently preferred embodiments described herein will be apparent to those skilled in the art. For example, the crane controller could be separate from other control systems of the crane, or it may be integrated with further functionality. Additionally, while not described in detail, one of ordinary skill in the art will recognize that the different embodiments may be used in combination with one another.

The invention claimed is:

1. A method for determining a capacity of a boom combination for a crane having a variable position counterweight in a locked position, the method comprising:

using a processor configured to implement computer executable instructions to perform the steps of:

determining a boom combination of the crane;

determining a maximum capacity of the crane at a hook position for the boom combination;

determining a maximum target value for an operating condition dependent on a balance of the crane between the variable position counterweight at a first distance from a center of rotation of the crane and a load on the hook;

receiving an indication of the locked counterweight position at a second distance from the center of rotation that is different than the first distance;

establishing at least one new target value for the operating condition dependent on the balance of the crane between the variable position counterweight at the second distance and the load on the hook; and, calculating a new capacity of the crane by decrementing the maximum capacity of the crane proportionally to a difference in the maximum target value and the at least one new target value.

2. The method of claim 1, further comprising preventing the variable position counterweight from moving to the locked position when at least one of (a) the new target value of the operating condition is greater than the maximum target value of the operating condition and (b) the new capacity of the crane is less than a minimum capacity.

3. The method of claim 1, wherein determining the boom combination comprises receiving a user input identifying a boom combination.

4. The method of claim 1, wherein determining the boom combination comprises detecting, by a sensor, at least one component making up the combination.

5. The method of claim 1, wherein determining the maximum capacity comprises looking up a load chart for the determined boom combination.

6. The method of claim 1, wherein the operating condition comprises a moment calculated about a fixed point on the crane.

7. The method of claim 6, wherein the moment comprises summing a load moment of at least one of a counterweight support beam supporting the variable position counterweight and a rotating bed supporting the variable position counterweight, a load moment of a mast hinge supporting at least one of a fixed mast and a live mast, and a load moment of a boom hinge supporting a boom.

8. A crane control system comprising:

a processor configured to implement computer executable instructions;

a first input interface in communication with the processor and configured to receive an indication of a locked position of a variable position counterweight;

a second input interface in communication with the processor and configured to receive an input corresponding to an operating condition indicative of a balance between a load on a crane boom and a variable position counterweight;

a first output interface in communication with the processor and configured to output a control signal for controlling the position of the variable position counterweight;

a second output interface in communication with the processor and configured to output an indication of a new capacity of the crane; and, a computer memory in communication with the processor and storing data representing a load chart and computer executable instructions, that when implemented by the processor cause the processor to perform functions comprising:

calculate the control signal for controlling the position of the variable position counterweight based on keeping the input received at the second input interface at or below a maximum target value for the operating condition dependent on a balance of the crane between the variable position counterweight at a first distance from a center of rotation of the crane and a load on the hook;

determine a maximum capacity of the crane at a hook position for the boom combination;

calculate at least one new target value for the operating condition based on the indication of the locked counterweight position received over the first interface and dependent on the balance of the crane between the variable position counterweight at a second distance that is different than the first distance and the load on the hook;

calculate a new capacity of the crane by decrementing the maximum capacity of the crane proportionally to a difference in the maximum target value and the at least one new target value; and, output an indication of the new capacity over the second output interface.

9. The crane control system of claim 8, wherein the processor further performs functions comprising prevent the variable position counterweight from moving to the locked position when at least one of (a) the new target value of the operating condition is greater than the maximum target value of the operating condition and (b) the new capacity of the crane is less than a minimum capacity.

10. The crane control system of claim 8, wherein the operating condition comprises a moment calculated about a fixed point on the crane.

11. The crane control system of claim 10, wherein the moment comprises summing a load moment of at least one of a beam counterweight support beam supporting the variable position counterweight and a frame rotating bed supporting the variable position counterweight, a load moment of a mast hinge supporting at least one of a fixed mast and a live mast, and a load moment of a boom hinge supporting a boom.

12. The crane control system of claim 8, further comprising a third input configured to receive an indication of a boom combination.

13. The crane control system of claim 12, wherein the function determine the maximum capacity comprises looking up the load chart for the determined boom combination.

14. A crane comprising:

an upper works;

a boom mounted to the upper works at a first end and having a hook at a second end;

a variable position counterweight horizontally extendable from the upper works;

a counterweight movement device configured to move the variable position counterweight relative to the upper works; and a crane control system, comprising:

a processor configured to implement computer executable instructions;

a first input interface in communication with the processor and configured to receive an indication of a locked position of a variable position counterweight;

a second input interface in communication with the processor and configured to receive an input corresponding to an operating condition indicative of a balance between a load on a crane boom and a variable position counterweight;

a first output interface in communication with the processor and configured to output a control signal for controlling the position of the variable position counterweight;

a second output interface in communication with the processor and configured to output an indication of a new capacity of the crane; and, a computer memory in communication with the processor and storing data representing a load chart and computer executable instructions, that when implemented by the processor cause the processor to perform functions comprising:

calculate the control signal for controlling the position of the variable position counterweight based on keeping the input received at the second input interface at or below a maximum target value for the operating condition dependent on a balance of the crane between the variable position counterweight at a first distance from a center of rotation of the crane and a load on the hook;

determine a maximum capacity of the crane at a hook position for the boom combination;

calculate at least one new target value for the operating condition based on the indication of the locked counterweight position received over the first interface and dependent on the balance of the crane between the variable position counterweight at a second distance that is different than the first distance and the load on the hook;

calculate a new capacity of the crane by decrementing the maximum capacity of the crane proportionally to a difference in the maximum target value and the at least one new target value; and, output an indication of the new capacity over the second output interface.

15. The crane of claim 14, wherein the processor further performs functions comprising prevent the variable position counterweight from moving to the locked position when at least one of (a) the at least one new target value of the operating condition is greater than the maximum target value of the operating condition and (b) the new capacity of the crane is less than a minimum capacity.

16. The crane of claim 14, the operating condition comprises a moment calculated about a fixed point on the crane.

17. The crane of claim 16, wherein the moment comprises summing a load moment of at least one of a beam counterweight support beam supporting the variable position counterweight and a frame rotating bed supporting the variable position counterweight, a load moment of a mast hinge supporting at least one of a fixed mast and a live mast, and a load moment of a boom hinge supporting a boom.

18. The crane of claim 14, further comprising a third input configured to receive an indication of a boom combination.

19. The crane of claim 14, wherein the function determine the maximum capacity comprises looking up the load chart for the determined boom combination.

* * * * *